United States Patent [19]

Nakamura et al.

[11] Patent Number: 4,970,017

[45] Date of Patent: Nov. 13, 1990

[54] PROCESS FOR PRODUCTION OF GRANULAR DETERGENT COMPOSITION HAVING HIGH BULK DENSITY

[75] Inventors: Masayoshi Nakamura, Chiba; Noboru Hara, Tokyo; Kazuo Nagoh, Chiba; Yuji Tai, Asaka, all of Japan

[73] Assignee: Lion Corporation, Tokyo, Japan

[21] Appl. No.: 285,377

[22] Filed: Dec. 16, 1988

Related U.S. Application Data

[63] Continuation of Ser. No. 27,091, Mar. 12, 1987.

[30] Foreign Application Priority Data

Apr. 25, 1985 [JP] Japan ..... 60-87448
May 29, 1985 [JP] Japan ..... 60-116033
Jun. 27, 1985 [JP] Japan ..... 60-141092

[51] Int. Cl.[5] ..... C11D 3/065; C11D 3/12

[52] U.S. Cl. ..... 252/174.13; 252/128; 252/135; 252/140; 252/174.14; 252/174.25; 252/536; 252/537

[58] Field of Search ..... 252/91, 128, 135, 140, 252/383, 384, 174.25, 174.14, 536, 537; 427/212; 264/117, 118

[56] References Cited

U.S. PATENT DOCUMENTS 3,933,670 1/1976 Brill et al. ..... 252/99
4,196,095 4/1980 Cala et al. ..... 252/140
4,228,025 10/1980 Jacobsen ..... 252/174.13
4,261,941 4/1981 Sherman et al. ..... 252/174.25
4,347,152 8/1982 WNixon ..... 252/174.13
4,397,777 8/1983 Yurko ..... 252/536
4,487,710 12/1984 Kaminsky ..... 252/531
4,582,615 4/1986 Ramachandran et al. ..... 252/174.25

OTHER PUBLICATIONS

Japan Kokoku 46-7586 (i.e., U.S. Patent No. 3574119).
Japan Kokai 49-74703 (i.e., U. S. Patent No. 4059538).
Japan Kokai 60-72999.
Japan Kokai 60-72998.

*Primary Examiner*—A. Lionel Clingman
*Assistant Examiner*—Alexander G. Ghyka
*Attorney, Agent, or Firm*—Armstrong, Nikaido, Marmelstein, Kubovcik & Murray

[57] ABSTRACT

A process for producing a granular detergent composition having a high bulk density comprising the steps of:

(i) kneading detergent ingredients to form a kneaded solid detergent mixture;
(ii) disintegrating the solid detergent mixture; and
(iii) coating the disintegrated granular detergent composition with water-insoluble finely divided powder particles having an average primary particle diameter of 10 μm or less.

7 Claims, No Drawings

PROCESS FOR PRODUCTION OF GRANULAR DETERGENT COMPOSITION HAVING HIGH BULK DENSITY

This application is a continuation of application Ser. No. 027,091 filed Mar. 12, 1987.

BACKGROUND OF THE INVENTION

1. Field of the Invention

The present invention relates to a process for producing a granular (or powdered) detergent composition having a high bulk density by disintegrating a solid detergent composition.

2. Description of the Related Art

Granular detergent compositions have heretofore been produced mainly by spray drying. In the spray drying process, detergent ingredients such as surfactants and builders are mixed with water to form a slurry having a water content of 35% to 50% by weight. The slurry thus obtained is sprayed, after heating, into a heated space in a spray dryer to form bead type hollow particles having a water content of 5% to 10% by weight and a bulk density of approximately 0.3 g/cc.

The spray drying is advantageous in that a hollow granular detergent having an excellent solubility can be obtained. However, since 30% to 40% by weight of water must be removed in the drying step, an extremely large heat energy is disadvantageously consumed. Also, since large scale production equipment is required, a large initial investment is necessary. Furthermore, since the granules obtained by the spray drying have a low bulk density, the packaging volume becomes disadvantageously large. Furthermore, since the granules obtained by spray drying have large irregularities on the surface of the granules, the flowability and appearance thereof are poor.

In addition, when granular detergents are prepared by the spray drying, the production of detergent compositions having a high surfactant content and the use of heat susceptible substances such as nonionic surfactants is limited. The spray drying is also disadvantageous in that, since powder dust is likely to be generated due to the finely divided powder particles, completely dust-free products are difficult to obtain.

Various attempts have been made to produce granular detergent compositions by methods other than spray drying. For instance, Japanese Examined Patent Publication (Kokoku) Nos. 46-7586 and 55-49535 and Japanese Unexamined Patent Publication (Kokai) No. 49-74703 disclose the use of substances having water of crystallization or substances capable of readily melting upon heating as a starting material for the production of granular detergent compositions. According to there methods, the above-mentioned substances are subjected to heat treatment to cause the discharge of water of crystallization therefrom or the melting thereof. These substances work as a binder to allow several to several dozen powder particles to be agglomerated and granulated. However, these methods still have problems from the practical point of view in that the particle size distributions of the resultant powder particles are wide or the water solubility thereof is poor.

Furthermore, Japanese Unexamined Patent Publication (Kokai) NOs. 60-72998 and 60-72999 recently disclose a method for neutralizing a mixture of alkylbenzene sulfonic acids and alkylsulfuric acid esters with sodium carbonate and a method for neutralizing sulfonates or sulfate with sodium carbonate, followed by disintegrating, after cooling to 40° C. or less, the neutralized product together with zeolite and the other detergent ingredients. However, these methods still have problems from the practical point of view in that the dispersibility and solubility of the resultant composition in cold water are poor and powder dust is remarkably generated from the products due to the post-addition of a large amount of the powdered zeolite. Thus, the commercial value is poor.

Still further, when certain surfactants such as olefin sulfonates are formulated into granular detergent compositions having a high bulk density, the solubility thereof in water is decreased and, therefore, a sufficient detergency cannot be obtained in a conventional washing time and the detergent powder is sometimes deposited on clothing after washing.

Furthermore, in order to improve the water solubility of a granular detergent composition having a high bulk density, a method is used of adding a foaming substance to the granular detergent composition. However, this method involves a problem in that, since the substance having no effects on the detergency is additionally included in the detergent composition, the amount of the composition used in each washing and, therefore, the washing cost are increased.

Pan granulators are also conventionally used in the production of granules having a larger bulk density. According to this granulation method, powder is introduced into a rotating pan and water drops are, then, dropped to form nuclei, followed by growing spherical granules. However, this method is disadvantageous in that not only is the production time long, but also the growing of the nuclei caused by the water drops is remarkably fluctuated so that the size of the spherical granules produced becomes remarkably nonuniform.

Japanese Examined Patent Publication (Kokoku) No. 58-44120 discloses the use of a marumerizer as a post granulation apparatus for granular detergent composition. The marumerizer is disclosed in Japanese Examined Patent Publication (Kokoku) NO. 41-563 and is an apparatus for adjusting particle sizes of granules or sphering granules. This apparatus is composed of a cylinder and a disc provided at the bottom of the cylinder . The disc is rotated at a high speed and the granular substances are rotated thereon during the operation. However, the use of the marumerizer involves problems in that a driving device is required for rotating the disc, the maintenance is troublesome since granulating substances are clogged in a clearance between the cylinder wall and the disc, and since a scaling-up of the apparatus is difficult, the treatment capacity is limited and a continuous operation is difficult.

SUMMARY OF THE INVENTION

Accordingly, the objects of the present invention are to eliminate the above-mentioned disadvantages of the prior art and to provide a process for producing a granular detergent composition capable of obtaining a granular detergent composition having a high bulk density (e.g. 0.6 g/cc or more), an extremely improved dispersibility and solubility in cold water, and excellent powder characteristics, while effectively preventing the generation of powder dust, at a remarkably decreased or substantially no drying energy, without using any additional substances having no effects on washing or cleaning action.

Other objects and advantages of the present invention will be apparent from the description set forth hereinbelow.

In accordance with the present invention, there is provided a process for producing a granular detergent composition having a high bulk density comprising the steps of:

(i) kneading detergent ingredients containing at least 10% by weight of potassium alkylaryl sulfonate to form a kneaded solid detergent mixture;

(ii) disintegrating the kneaded solid detergent mixture; and (iii) coating the disintegrated granules detergent composition with water-insoluble finely divided powder particles having an average primary particle diameter of 10 μm or less.

In accordance with the present invention, there is also provided a process for producing a granular detergent composition having a high bulk density comprising the steps of:

(i) kneading detergent ingredients containing 30% to 60% by weight of a surfactant including at least 10% by weight of an olefin sulfonate and 25% to 55% by weight of an alkali builder including 1% to 15% by weight of a silicate having a ratio of $Na_2O$ to $SiO_2$ of 1.0 to 3.5, the content of potassium in the form of the potassium salts being 1.5% to 50% by weight of the total amount of the surfactant to form a kneaded solid detergent mixture;

(ii) disintegrating the kneaded solid detergent mixture; and (iii) coating the disintegrated granular detergent composition with water-insoluble finely divided powder particles having an average primary particle diameter of 10 μm or less.

BRIEF DESCRIPTION OF THE DRAWINGS

The present invention will be better understood from the description set forth below with reference to the drawings, in which:

FIGS. 1 to 3 are schematic views of a spherizer; and

FIG. 4 is a cross-sectional view of one circle coil portion of the pipe in the spherizer shown in FIG. 3.

DESCRIPTION OF THE PREFERRED EMBODIMENTS

When the alkylaryl sulfonate is used as a surfactant in the production of the granular detergent composition, the alkylaryl sulfonic acids, preferably having an alkyl group with 8 to 18 carbon atoms, are neutralized with a concentrated potassium hydroxide solution. The use of potassium hydroxide as a neutralizing agent in the present production process involving no drying step or only a simple drying step is advantageous in the neutralization reactivity and unexpectedly and uniquely improves the solubility of the resultant granular detergent compositions in cold water. These advantageous results cannot be obtained from the use, as a neutralizing agent, of, for example, sodium hydroxide, sodium silicate, potassium silicate, sodium carbonate, and potassium carbonate. Preferably, the concentration of the resultant potassium alkylaryl sulfonate is at least 10% by weight of the resultant granular detergent composition.

In the practice of the neutralization, potassium hydroxide is mixed, as a concentrated aqueous solution, with an alkylaryl sulfonic acid. The concentration of the aqueous potassium hydroxide solution is preferably such that a disadvantageous amount of water in the subsequent mixing, kneading, and disintegrating steps is not introduced in the system. Typically, the concentration of the aqueous potassium hydroxide solution is preferably at least 40% by weight, more preferably 45% by weight or more. The potassium hydroxide is preferably used in an amount of 1.0 to 1.2 moles based on 1 mole of an alkylaryl sulfonic acid, mixtures are first prepared by intimately mixing detergent ingredients containing at least one neutralized sulfonate, as a surfactant, in, for example, a kneader. The typical examples of the alkylaryl sulfonic acids are alkylbenzene sulfonic acids having an alkyl group with 8 to 18 carbon atoms.

Furthermore, in the neutralization step, sulfates such as alkyl sulfuric acid esters or the other sulfonated products can be used, in addition to the abovementioned alkylaryl sulfonic acids. For example, when (a) alkylaryl sulfonic acids and (b) alkylsulfuric acid esters are used together, both the components (a) and (b) can be preferably used in a weight ratio of (a)/(b)=1/0 to ½. When the other sulfonic acids or sulfated products are used, together with the alkylaryl sulfonic acid, an additional amount of the potassium hydroxide sufficient to neutralize the other sulfonic acids or sulfated products should be used.

The neutralized products or sulfonates obtained above are intimately mixed and kneaded with other detergent ingredients. Examples of the other detergent ingredients are other anionic surfactants such as alkyl sulfates, olefin sulfonates, soaps, and alcohol ethoxy sulfates; nonionic surfactants such as alkyl ethoxylates and alkylphenyl ethoxylates; ampholytic surfactants such as betain type and alanine type surfactants; alkali builders such as silicates, carbonates, bicarbonates, percarbonates, borates, perborates, tripolyphosphates, and pyrophosphates (typically sodium and potassium salts); chelating builders such as sodium citrate, sodium ethylenediamine tetraacetate, zeolites (e.g., type A zeolite), and sodium nitrilotriacetate; neutral builders such as sodium sulfate; and conventional detergent ingredients such as a fluorescent agent, carboxymethyl cellulose, polyethylene glycol, enzymes, perfumes, and coloring matters.

When the alkylaryl sulfonates are used together with alpha-olefin sulfonates, the resultant granular detergent compositions have a high bulk density and an improved storage stability and do not cause unpreferable blocking during the storage. The preferable alpha-olefin sulfonates are those having 12 to 18 carbon atoms in the form of sodium and potassium salts. The preferable amount of the alpha-olefin sulfonates is 5% by weight or more of the resultant granular detergent composition.

When the olefin sulfonates are used as a surfactant, the granular detergent composition according to the present invention preferably comprises 30% to 60% by weight of a surfactant including at least 10% by weight of an olefin sulfonate and 25% to 55% by weight of an alkali builder including 1% to 15% by weight of a silicate having a ratio of $Na_2O$ to $SiO_2$ of 1.0 to 3.5 and the content of potassium in the form of the potassium salts is 1.5% to 50% by weight of the total amount of the surfactant.

Examples of the olefin sulfonates are the neutralized and hydrolyzed salts of the sulfonated products of alpha-olefines, vinyliden type olefins, and inner olefins. Hydroxyalkane sulfonates may be included in addition to the alkene sulfonates. The amount of the olefin sulfonates in the granular detergent compositions is preferably 10% by weight, more preferably 10% to 30% by weight. When the amount of the olefin sulfonates is less than 10% by weight, the excellent detergency characteristics of the olefin sulfonates are not likely to be exhibited. The granular detergent composition according to the present invention can contain the olefin sulfonates alone but can additionally contain the other surfactants such as anionic surfactants (e.g., alkylbenzene sulfonates, fatty acid salts, higher alcohol ethoxy sulfates, and higher alcohol sulfates) and nonionic surfactants.

The granular detergent composition including the olefin sulfonates, preferably, contains 25% to 55% by weight, more preferably 25% to 40% by weight of the alkali builders such as silicates, carbonates, bicarbonates, borates, and perborates. However, the silicates, e.g., sodium silicate having a ratio $Na_2O/SiO_2$ of 1.0 to 3.5, more preferably 1.0 to 2.5 are preferably used as at least one part of the alkali builders in the granular detergent compositions preferably in an amount of 1% to 15% by weight, more preferably 2% to 10% by weight. When the ratio $Na_2O/SiO_2$ is less than 1.0, the desired water solubility tends to decrease. Contrary to this, when the ratio $Na_2O/SiO_2$ is more than 3.5, the pH tends to increase and, therefore, an unpreferable hand roughening occurs. The use of too large an amount of the sodium silicate tends to cause an unpreferable increase in the pH, whereas the use of too small an amount of the sodium silicate tends to reduce the desired results. The ratio $Na_2O/SiO_2$ can be adjusted with the addition of sodium hydroxide.

As mentioned above, the potassium content in the total amount of the surfactants is preferably 1.5% to 50% by weight, more preferably 3% to 40% by weight, in the present granular detergent compositions containing the olefin sulfonates. When the potassium content is less then 1.5% by weight, the water solubility tends to be decreased. Contrary to this, when the potassium content is more than 50% by weight, the detergent characteristics such as the storage stability tends to be decreased. The content of the potassium can be adjusted by using the potassium salts as a surfactant and/or the potassium salts as an alkali builder.

When zeolites are included in the present granular detergent composition, the zeolites are preferably used in such an amount that the content in the detergent composition is 5% to 35% by weight, more preferably 10% to 30% by weight. The zeolites also can be used as a water-insoluble finely divided powder in a subsequent step. The amount of zeolites used in the mixing or kneading step is preferably 70% or more, more preferably 80% or more, of the total amount of the zeolites contained in the final granular detergent composition. When the amount of the zeolites used in the mixing and kneading step is too small, the resultant mixture becomes too soft and, therefore, prior to the disintegration, it is necessary that the kneaded product be cooled or a large amount of powder such as zeolite powder be added, as a disintegrating additive, during the disintegrating step. The addition of a large amount of the disintegrating additive causes a problem of generating powder dust.

In the kneading step, the ingredients are preferably mixed or kneaded by adjusting the water contents in such a manner that the water content of the resultant mixture becomes 5% to 15% by weight, from the viewpoints of easy handling of the resultant mixture and the improvement in the characteristics of the mixture required as a disintegrating starting material. When the water content is too small, powder dust is likely to be generated due to the excessive powderization during the integrating step. Contrary to this, when the water content is too large, the desirable continuous operation becomes difficult due to the excessive deposition of the mixture in the disintegrating machine and the formation of the molten mixture in the machine. The "water content" includes the water of crystallization or bound water in, for example, zeolites.

The intimately kneaded solid detergent mixture is then disintegrated in a disintegrating machine. Since the temperature of the solid detergent mixture increases during the disintegration due to the frictional heat, cooling air having a temperature of, for example, 20° C. or less, is introduced into the disintegrating machine at a rate of, for example, 10 liters or more per 1 kg of the solid detergent mixture.

The disintegration is preferably carried out by using a disintegrating machine provided with a classification mechanism such as a screening or air classification device or by classifying the disintegrated powder particles with a sieve, followed by recycling the powder particles having a particle size outside the predetermined range to the disintegrating machine. Thus, powder particles having a narrow particle size distribution range, e.g., having an average particle diameter of 300 to 2000 μm, are obtained.

The disintegrating machines usable in the present invention are those which are provided with, for example, multi-stage rotating disintegrating blades and a 360° open type screen through which the disintegrated powder particles pass. These types of disintegrating machines are advantageous in that the upper particle size can be optionally controlled by adjusting the opening size of the screen and that a very sharp particle size distribution can be obtained since overgrinding is prevented and the amount of the excessively divided fine powder is minimized. A typical example of such a disintegrating machine is the Speed Mill Model ND-30 (manufactured by OKADA SEIKO Co., Ltd.), although any disintegrating machine, preferably provided with a classification mechanism and a means for introducing cooling air to the grinding space, can be used in the present invention. Furthermore, grinding aids such as powdered sodium carbonate can be used in the disintegrating step.

The disintegrated powder particles of the detergent composition are then coated with water-insoluble finely divided powder particles to modify the surface of the disintegrated detergent composition particles. The term "water-insoluble" substance used herein includes slightly water-soluble substances.

The water-insoluble finely divided powder particles usable in the present invention are those having an average primary particle diameter of 10 μm or less, preferably 4 μm or less, more preferably 0.01 to 4 μm. When the average primary particle diameter of the water-insoluble finely divided powder particles is too large, a uniform coating cannot be effected and, therefore, the flowability or fluidity and storage stability cannot be improved. Although the amount of the water-insoluble finely divided powder particles is specifically limited, the water-insoluble finely divided powder particles are preferably added in an amount of 0.5% to 5% by weight of the disintegrated detergent composition.

Examples of above-mentioned finely divided powder particles are calcium stearate, magnesium stearate, alumino silicates such as type A zeolite, calcium carbonate, magnesium carbonate, magnesium silicate, silicon dioxide (or white carbon), and titanium dioxide.

The coating of the disintegrated detergent composition with the finely divided powder particles effectively prevents adhesion between the powder particles and the blocking during storage. In addition, the coating of the finely divided powder particles modifies the surface characteristics of the granular detergent composition to improve the flowability. This also improves the solubility, imparting a practically acceptable solubility in cold water, due to the retention of excess water in the powder particles of the granular detergent composition.

The coating can be carried out by using any coating apparatus such as a tumbling granulator, fluidized bed or mixing drum.

The granular detergent composition prepared above can be directly marketed or marketed after incorporating a micro amount of ingredients such as perfumes. However, if desired, the granular detergent composition can be further uniformly granulated, by using a spherizer such as a MARUMERIZER (manufactured by Fuji Paudal Co., Ltd.), to a substantially spherical form. Also, the water content of the resultant granular detergent composition can be adjusted by warm air drying.

According to the preferred embodiment of the present invention, the disintegrated granular detergent composition is then treated in a circulating or revolving gas stream along the inner wall of a vessel for a time sufficient to increase the bulk density of the granular detergent composition, whereby the granular detergent composition is brought into contact with the vessel wall to obtain more spherical and dense granules.

Referring to FIG. 1, one example of an apparatus for treating the disintegrated granular detergent composition is perspectively shown. The apparatus shown in FIG. 1 has a structure similar to that of a cyclone. A vessel 11 is composed of a cylindrical portion 11*a* and a conical portion 11*b* continuous from the cylindrical portion 11*a*. The granular detergent composition carried with a gas stream is introduced from an inlet 13 to the vessel 11. The gas stream is tangentially introduced into the cylindrical portion 11*a* and forms a circulating or revolving stream along the inner wall of the cylindrical portion 11*a*. The detergent granules carried in the gas stream repeatedly come in contact with or collide with to the inner wall. Thus, the irregular surfaces of the granules are smoothed by friction and the more spherical and dense granules having a higher bulk density can be obtained. The treated granular detergent composition is allowed to fall down by gravity and is recovered from a granule outlet 15, while the gas stream is discharged from a gas outlet 17.

The apparatus shown in FIG. 1 is similar to a conventional cyclone in the shape or structure thereof. However, the dimension and the surface roughness of the inner wall can be appropriately designed depending upon the purpose or degree of the treatment. For example, the height or length of the conical portion of a cyclone is generally 2 or 2.5 times the diameter of the cylindrical portion. However, according to the present invention, when the height or length of the vessel is longer, the chance of the contact of the granules with the inner wall and, therefore, the formation of the spherical and dense granules is advantageously facilitated. Furthermore, when the inner wall is somewhat rough, the treatment efficiency is increased as long as the roughness of the inner wall is less than the particle size of the detergent granules.

FIG. 2 shows another example of an apparatus for treating the detergent granules according to the present invention. This apparatus 11 is composed of a conical vessel. The hollow vessel 11 has an inlet 13 and an outlet 19. A gas stream carrying detergent granules to be treated is tangentially introduced via the inlet 13 to the vessel 11 and forms a circulating stream along with the inner wall of the vessel 11. Thus, the detergent granules are repeatedly in contact with or collide with the inner wall. As a result, the irregular surfaces of the granules are smoothed and more spherical and dense granules having a higher bulk density are discharged with the gas stream from the outlet 19. The vessel shown in FIG. 1 may be in the form of a cylindrical vessel.

The inlets and outlets of the vessels shown in FIGS. 1 and 2 may have a cross-section of a cylinder or prism.

FIG. 3 shows a further example of the apparatus for treating the detergent granules according to the present invention. This vessel 11 is composed of a coiled pipe 21. The gas stream carrying the detergent introduced from an inlet 13 to the vessel 11. The gas stream forms a circulating stream along the inner wall of the vessel 11 as the gas stream flows through the coiled pipe 21. Similarly in FIGS. 1 and 2, the gas stream is generally tangentially introduced into the coiled pipe 21. Thus, the detergent granules are repeatedly in contact with or collide with the inner wall, whereby the detergent granules are treated in the same manner as mentioned above. The detergent granules thus treated are discharged, together with the gas stream, from the outlet 19. In this example, as illustrated in FIG. 4, since the granules are in contact with or collide with not only the outer side wall 21*a* but also the bottom wall 21*b*, the treatment efficiency is increased.

FIG. 4 illustrates the cross-section of the one circle coil portion of the coiled pipe 21. The above-mentioned effect of the coiled pipe can be similarly obtained when inwardly projecting partitions are helically mounted at the inner walls of the cylindrical or conical vessel as shown in FIG. 1 or 2. This is because the detergent granules then come into frictional contact with the upper surface of the partitions.

Furthermore, when the gas stream is introduced, not in parallel but at an inclination, into the pipe, the preferable circulating or revolving stream can be obtained in the pipe. Thus, since the entire inner surface of the pipe can be effectively utilized in the treatment of the detergent granules and since the flow path of the granules is extended, the treatment efficiency is further increased.

Any detergent granules can be treated according to the present invention. However, a larger amount of surfactants or water is preferably included as long as the composition is not excessively sticky, so that the resultant granules can be effectively prepared in the form of more spherical and dense granules.

Examples of gas usable in the treatment of the detergent granules are air and inert gases such as nitrogen. The use of air is economically preferable. The temperature and humidity of the gas are appropriately selected. A temperature higher than that of an ambient temperature and a relative humidity of 50% or more can be used to afford plasticity to the granules. The temperature can be increased to partially dry the granules during the treatment. The velocity of the gas introduced into the vessel can be appropriately selected as long as the granules can be carried in the gas stream. Although the granular detergent composition can be separately introduced into the vessel where the circulating gas stream is previously established, the granules are preferably introduced with the gas stream to the vessel, as explained above.

The treatment according to the present invention may be carried out for a time sufficient to increase the bulk density of the detergent composition. The bulk density can be controlled by the size and shape of the treating vessel and the use of the apparatuses in series.

According to the present invention, the desired granular detergent composition having excellent powder properties, good flowability, and anti-blocking properties during storage can be advantageously prepared without any substantial drying energy. Thus, an energy-saving process for producing the desired granular detergent composition can be provided. Furthermore, the granular detergent composition according to the present invention is not in the form of hollow powder particles, unlike the conventional spray dried product. Therefore, the bulk density thereof is increased (e.g., approximately 0.6 g/cc or more) and the content of the active ingredients can be increased. Furthermore, the granular detergent composition according to the present invention has a good solubility in cold water and has solubility characteristics sufficient to fulfill the requirements for a granular detergent.

Furthermore, when the granular detergent composition is further treated in a circulating gas stream according to the present invention, the granular detergent composition having a higher bulk density and a more spherical shape can be obtained at a high yield. Thus, the resultant granules are suitable for transportation, feeding, and storage. In addition, since this treating apparatus has neither revolving portions nor driving means, the maintenance of the apparatus is simple, and a scaling-up of the apparatus and continuous operation can be advantageously accomplished.

EXAMPLES

The present invention will now be further illustrated by, but is by no means limited to, the following examples and comparative examples, wherein all parts and percentages are expressed on a weight basis unless otherwise specified.

EXAMPLE 1

An aqueous high concentration solution of potassium dodecylbenzene sulfonate was prepared by introducing 17.9 kg/hr of dodecylbenzene sulfonic acid (effective component =96%) and 7.1 kg/hr of potassium hydroxide (aqueous solution having a solid content of 48%) into a static mixer SWJ 25-12 (manufactured by Toray Co., Ltd.) by using a non-pulse type pump.

The resultant neutralized product had an effective component of 82% and the rate of neutralization reaction was more than 99%. Cooling water having a temperature of 10° C. was circulated through a jacket provided at the static mixer at a rate of 5 l/min to prevent color deterioration of the neutralized product due to the neutralization heat. Thus, a neutralized product having a temperature of 50° C. was obtained. The color of the neutralized product was equal to that of the low concentration neutralized product obtained by neutralizing an aqueous solution having an effective component amount of 35%.

The following detergent ingredients were mixed in a ribbon mixer and, the mixture was then introduced into a constant powder feeder.

| Other detergent component | % by weight |
|---|---|
| Sodium alpha-olefin sulfonate (effective content = 96%) | 21.8 |
| Type A zeolite (solid content = 80%) | 35.0 |
| Sodium silicate powder (solid content = 78%) | 25.1 |
| Potassium carbonate (solid content = more than 95%) | 7.3 |
| Sodium carbonate (solid content = more than 95%) | 7.3 |
| Soap, fluorescent agent, carboxymethyl cellulose | 3.5 |

A 71.4 kg/hr amount of the resultant powder mixture and 25.0 kg/hr of the potassium dodecylbenzene sulfonate obtained above were introduced into a kneader (i.e., KRC type #2 Kneader manufactured by Kurimoto Ltd.) to obtain a uniformly kneaded mixture in the form of a sheet having a thickness of 3 mm and a width of 50 mm and a temperature of 50° C. to 55° C.

The resultant mixture in the form of a sheet was pelletized in a pelleter (i.e., Pelleter Double EXDF-60 manufactured by Fuji Paudal Co., Ltd.) to facilitate the disintegration. Thus, cylindrical pellets having a size of 5mm$\phi\times$5 mm and having a temperature of 50° C. to 55° C. were obtained. The pellets thus obtained were continuously and quantitatively fed to a disintegrating machine (i.e., a Speed Mill Model ND-30 manufactured by OKADA SEIKO Co., Ltd.), while 15 liters of cooling air having a temperature of 15° C. was simultaneously introduced per 1 kg of the mixed composition. The disintegrating machine was provided with four crossing disintegrating blades having a diameter of 15 cm and a screen composed of a punched metal sheet having a pore diameter of 2 mm and an opening ratio of 20%. The blade was operated at 3000 rpm.

A 97 parts amount of the disintegrated detergent composition obtained above and 3 parts of type A zeolite having an average primary particle diameter of 3 μm were continuously and quantitatively fed to a rolling drum having a diameter of 30 cm and a length of 60 cm. The rolling drum was operated at 30 rpm. The coated product was discharged at a retention time of 5 minutes. Thus, a granular detergent composition having a high bulk density was prepared.

The properties of the resultant disintegrated and coated products are shown in Table 1. For reference, the data of commercially available granular detergents obtained by spray drying are also shown.

The sphericity, dust generation amount, storage stability, and solubility in cold water were evaluated as follows:

(1) Sphericity

Sphericity of the particles was defined as an average ratio of the short diameter to the long diameter of the particle determined for 1000 particles by means of an optical microscope.

(2) Dust Generation Amount

A determination device was set as follows. That is, a blower is provided at the bottom of a glass tube having a diameter of 50 mm and a height of 500 mm so that air was fed via the bottom of the glass tube. The glass tube was provided with a 100 mesh screen at the bottom thereof. The top of the glass tube was connected to a dust collector having a diameter of 30 mm filled with glass fiber.

A 30 g amount of the granular detergent composition was charged to the glass tube and dry compressed air having a relative humidity of less than 60% was fed at a rate of 30 liters/min for one minute through the glass tube from the blower.

The dust collector was removed and the weight was measured to obtain increase in weight of the dust collector compared with the weight of the dust collector before the test. The amount of generation of the dust was calculated from the following equation.

$$\text{Dust generation amount} = \frac{\text{Increased weight of dust collection (mg)}}{30\ (\text{l/min})}$$

(3) Storage Stability Evaluation Test

The granular detergent composition was filled or packed by 90% volume into 660 ml neosand cartons having a size of 11cm×4cm×15 cm. After sealing, the cartons were stored for seven days under a temperature of 35° C. and an RH of 85%. Thereafter, the cartons were opened, and the amount of the granular detergent compositions passing through the opening of a 6 mesh (Tylor) screen was measured.

The stability of the granular detergent compositions against caking was evaluated according to the following criteria:

+. . . Amount not passing through the openings is less than 10%.

±. . . Amount not passing through the opening is 10% to 30%.

±. . . Amount not passing through the opening is more than 30%.

(4) Solubility in Cold Water

A 25 g amount of the granular detergent composition was charged to a bag made of nylon tricot having a size of 5cm×10 cm. The upper portion of the bag was tied with a rubber string. Thus, the bag filled with the detergent composition was prepared.

The detergent bag thus prepared was charged to the following washer and, after allowing to stand for 2 minutes, the washer was operated for 5 minutes under the following conditions:

| | |
|---|---|
| Washer: | Aozora PS-5300 (manufactured by Hitachi Ltd.) |
| Water temp: | 5° C. |
| Water amount: | 30 liters |
| Cloth to be washed: | Cotton 1.5 kg |

The bag filled with the detergent composition was taken out of the washer. The bag was placed in a dryer and then dried at a temperature of 105° C. for hours.

The insoluble matter of the granular detergent composition was obtained as follows:

$$\frac{\text{Bag weight after test} + \text{Insoluble matter} - \text{Bag weight before test}}{25} \times 100(\%)$$

EXAMPLE 2

The disintegrated detergent composition obtained in Example 1 was coated with 3 parts of calcium carbonate having an average primary particle diameter of 4 μm in the same manner as in Example 1.

The properties of the coated product thus obtained are shown in Table 1.

EXAMPLE 3

The disintegrated detergent composition obtained in Example 1 was coated with 1.5 parts of silicon dioxide having an average primary particle diameter of 0.3 μm in the same manner as in Example 1.

The properties of the coated product thus obtained are shown in Table 1.

EXAMPLE 4

The coated product obtained in Example 1 was treated in a MARUMERIZER Q-400 (manufactured by Fuji Paudal Co., Ltd.) for 5 minutes to uniformly adjust the particle shapes.

The properties of the product thus obtained are shown in Table 1.

EXAMPLE 5

The granular detergent composition was obtained in the same manner as in Example 1, except that the sodium alpha-olefin sulfonate was omitted from the detergent ingredient used in Example 1.

The properties of the product thus obtained are shown in Table 1.

COMPARATIVE EXAMPLE 1

The disintegrated detergent composition obtained in Example 1 was coated with 5 parts of calcium carbonate having an average primary particle diameter of 15 μm in the same manner as in Example 1.

The properties of the product thus obtained are shown in Table 1.

COMPARATIVE EXAMPLE 2

The granular detergent composition was obtained in the same manner as in Example 1, except that a 48% aqueous sodium hydroxide solution was used, instead of potassium hydroxide solution, as a neutralizing agent.

The properties of the product thus obtained are shown in Table 1.

TABLE 1

| | | Example | | | |
|---|---|---|---|---|---|
| | | 1 | 2 | 3 | 4 |
| Preparation Condition | | | | | |
| Neutralizing agent | | 48% KOH | 48% KOH | 48% KOH | 48% KOH |
| Coating agent | Kind | Zeolite | $CaCO_3$ | $SiO_2$ | Zeolite |
| | Particle size (μm) | 3 | 4 | 0.3 | 3 |
| | Amount (wt %) | 3 | 3 | 1.5 | 3 |
| Particle shape adjustment | | No | No | No | Yes |
| Properties of Granular Detergent | | | | | |
| Particle size distribution | 10 mesh residue (%) | 1 | 1 | 1 | 2 |
| | 10–24 mesh (%) | 55 | 57 | 52 | 60 |
| | 24–60 mesh (%) | 42 | 41 | 45 | 37 |

TABLE 1-continued

| | | | | | |
|---|---|---|---|---|---|
| | 60 mesh pass | 2 | 1 | 2 | 1 |
| Angle of repose (degree) | | 40 | 40–45 | 40 | 37 |
| Bulk density (g/cc) | | 0.85 | 0.8 | 0.82 | 0.9 |
| Sphericity | | 0.8 | 0.8 | 0.8 | 0.98 |
| Dust generation amount | | 0.2 | 0.4 | 0.2 | 0.1 |
| Storage stability | | + | + | + | + |
| Solubility in cold water | | 5 | 5 | 4 | 6 |

| | | Example | Comparative Example | | |
|---|---|---|---|---|---|
| | | 5 | 1 | 2 | |
| Preparation Condition | | | | | |
| Neutralizing agent | | 48% KOH | 48% KOH | 48% NaOH | Commercially Available Detergent |
| Coating agent | Kind | Zeolite | $CaCO_3$ | Zeolite | |
| | Particle size (μm) | 3 | 15 | 3 | |
| | Amount (wt %) | 3 | 5 | 3 | |
| Particle shape adjustment | | No | No | No | |
| Properties of Granular Detergent | | | | | |
| Particle size distribution | 10 mesh residue (%) | 3 | 3 | 1 | 1 |
| | 10–24 mesh (%) | 62 | 64 | 50 | 40 |
| | 24–60 mesh (%) | 35 | 33 | 46 | 39 |
| | 60 mesh pass | 0 | 0 | 3 | 20 |
| Angle of repose (degree) | | 45–50 | 50–60 | 40–45 | 45–50 |
| Bulk density (g/cc) | | 0.8 | 0.7 | 0.8 | 0.3 |
| Sphericity | | 0.78 | 0.75 | 0.8 | 0.8 |
| Dust generation amount | | 0.2 | 2 | 0.2 | 6 |
| Storage stability | | ± | − | + | ± |
| Solubility in cold water | | 4 | 15 | 50 | 1 |

EXAMPLES 6 TO 11 AND COMPARATIVE EXAMPLES 3 TO 5

The compositions shown in Table 2 were kneaded in a kneader.

The alkylbenzene sulfonates (i.e., LAS-Na and LAS-K) were prepared by neutralizing alkylbenzene sulfonic acid with NaOH and/or KOH in the kneader.

The resultant mixtures were disintegrated in a speed mill (type ND-30 manufactured by OKADA SEIKO CO., LTD.) and coated with type A zeolite having an average primary particle size of 3 μm. The compositions were optionally uniformly granulated for 5 minutes in a MARUMERIZER (manufactured by Fuji Paudal Co., Ltd., Q-400). Thus, the desired granular detergent compositions were obtained.

The granulated products having a size of 16 to 32 mesh were recovered and the dissolving test was carried out. The results are shown in Table 2.

The abbreviations in Table 1 are as follows:

AOS-Na (or K): Sodium (or Potassium) alpha-olefin sulfonates having 14 to 18 carbon atoms.

LAS-Na (or K): Sodium (or Potassium) linear alkylbenzene sulfonates having 10 to 14 carbon atoms.

DISSOLVING TEST

A 5 liters amount of water having a temperature of 5° C. and 250 g of cloth were added to a mini-size washer (i.e., National NA-35). While stirring, the sample detergent composition was once added. The time when the detergent was added was set to zero and about 20 cc of the washing liquor was sampled at one minute intervals. The samples were rapidly filtered with suction filter and the content of the surfactant dissolved in the filtrate was determined. The time when the content of the surfactant became 95% of the theoretical value was defined as a "dissolving time".

TABLE 2

| | Example | | | | | | Comparative Example | | |
|---|---|---|---|---|---|---|---|---|---|
| | 6 | 7 | 8 | 9 | 10 | 11 | 3 | 4 | 5 |
| Composition (%) | | | | | | | | | |
| AOS-Na | 10 | 15 | 20 | — | 20 | 15 | 15 | 20 | 20 |
| AOS-K | — | — | — | 15 | — | — | — | — | — |
| LAS-Na | 12.5 | 10 | — | 20 | 20 | 20 | 20 | 20 | — |
| LAS-K | 12.5 | 10 | 20 | — | — | — | — | — | 20 |
| Sodium Silicate | 10 | 5 | 2 | 5 | 5 | 15 | 5 | 10 | — |
| ($Na_2O/SiO_2$ ratio) | (1.0) | (2.0) | (2.0) | (1.0) | (2.5)*1 | (1.0) | (0.45) | (1.0) | |
| Sodium Carbonate | 20 | 20 | 25 | 15 | — | 10 | 25 | 20 | 25 |
| Potassium Carbonate | — | — | — | 10 | 25 | 10 | — | — | — |
| Type A Zeolite | 20 | 20 | 18 | 20 | 15 | 15 | 20 | 15 | 20 |
| Water | | | | | Balance | | | | |
| Bulk density (g/cc) | 0.83 | 0.92*2 | 0.90*2 | 0.80 | 0.85 | 0.78 | 0.92*2 | 0.80 | 0.90*2 |
| Dissolving Time (min.) | 2.0 | 2.5 | 2.5 | 1.5 | 1.0 | 1.0 | 6 | 4.5 | 5 |

*1 $Na_2O/SiO_2$ was adjusted to 2.5 with solid NaOH.
*2 Particle shape adjustment was made by A MARUMERIZER.

EXAMPLE 12

The following composition was kneaded in a kneader.

| Ingredient | % by weight |
|---|---|
| Sodium $C_{14}$–$C_{18}$ alpha-olefin sulfonate | 20 |
| Dodecylbenzene sulfonic acid | 20 |
| Potassium hydroxide | 4 |
| Type A zeolite | 15 |
| Sodium carbonate | 15 |
| Potassium carbonate | 15 |
| Other additives (e.g., CMC, fluorescent agent) | 3 |
| Water | Balance |

A 94 parts amount of the intimately kneaded mixture having a water content of 12% in the form of pellets having a size of 2 cm and 3 parts of sodium carbonate were fed at a constant speed to a disintegrating machine (Speed mill ND-30 manufactured by Okada Seiko Co., Ltd.). The disintegrating machine was provided with four crossing disintegrating blades having a diameter of 15 cm and a screen composed of a punched metal sheet having a pore diameter of 2 mm and an opening ratio of 20%. The blade was operated at 3000 rpm.

The bulk density of the resultant disintegrated granules was 0.60 g/cc.

The disintegrated granules obtained above were treated in an apparatus having the following dimensions illustrated in FIG. 1. The feed air rate was 20 m/sec.

Diameter of cylindrical portion: 15 cmϕ

Length of cylindrical portion: 15 cm

Length of conical portion: 30 cm

The granules were repeatedly passed through the apparatus. The bulk density was determined at each pass.

The results are shown in Table 3.

TABLE 3

| Treatment cycle | Bulk density (g/cc) |
|---|---|
| 1 | 0.61 |
| 3 | 0.65 |
| 5 | 0.70 |
| 10 | 0.73 |
| 15 | 0.75 |

EXAMPLE 13

The disintegrated granules obtained in Example 12 were treated in an apparatus having the following dimensions, as illustrated in FIG. 3. The air was fed at a constant speed of 15 m/sec.

Diameter of pipe: 5 cmϕ

Outer diameter of coil: 30 cmϕ

Turning number of coil: 6

The results are shown in Table 5.

TABLE 4

| Treatment cycle | Bulk density (g/cc) |
|---|---|
| 1 | 0.63 |
| 3 | 0.70 |
| 5 | 0.78 |
| 10 | 0.82 |
| 15 | 0.85 |

EXAMPLE 14

The granulated composition obtained in the Example 11 was treated in the apparatus used in Example 13. The results are shown in Table 5.

TABLE 5

| Treatment cycle | Bulk density (g/cc) |
|---|---|
| 1 | 0.80 |
| 3 | 0.83 |
| 5 | 0.85 |
| 10 | 0.88 |
| 15 | 0.87 |

We claim:

1. A process for producing a granular detergent composition having a high bulk density comprising the steps of:
   (i) kneading detergent ingredients containing at least 10% by weight of potassium alkylaryl sulfonate to form a kneaded solid detergent mixture;
   (ii) disintegrating the kneaded solid detergent mixture; and subsequently
   (iii) coating the disintegrated granular detergent composition with 0.5% to 5% by weight, based on the weight of the disintegrated detergent composition, of water-insoluble finely divided powder particles having an average primary particle diameter of 10 μm or less.

2. A process as claimed in claim 1, wherein said alkylaryl sulfonate is an lkylbenzene sulfonate having an alkyl group with 8 to 18 carbon atoms.

3. A process as claimed in claim 1, wherein the average particle diameter of the disintegrated detergent composition is 300 2000 μm.

4. A process as claimed in claim 1, wherein the water-insoluble finely divided powder particles are those derived from calcium stearate, magnesium stearate, alumino silicate, calcium carbonate, magnesium carbonate, magnesium silicate, silicon dioxide, or titanium dioxide.

5. A process for preparing a granular detergent composition as claimed in claim 1, wherein the disintegrated granular detergent composition is treated in a circulating gas stream along the inner wall of a vessel for a time sufficient to increase the bulk density of the granular detergent composition.

6. A process for producing a granular detergent composition having a high bulk density comprising the steps of:
   (i) kneading detergent ingredients containing 30% to 60% by weight of a surfactant including at least 10% by weight of an olefin sulfonate and 35% to 55% by weight of an alkali builder including 1% to 15% by weight of a silicate having a ratio of $Na_2O$ to $SiO_2$ to 3.5, the content of potassium in the form of the potassium salts being 1.5% to 50% by weight of the total amount of the surfactant to form a kneaded solid detergent mixture.
   (ii) disintegrating the kneaded solid detergent mixture; and subsequently
   (iii) coating the disintegrated granular detergent composition with 0.5% to 5% by weight, based on the weight of the disintegrated detergent composition, of water-insoluble finely divided powder particles having an average primary particle diameter of 10 μm or less.

7. A process for preparing a granular detergent composition as claimed in claim 6, wherein the disintegrated granular detergent composition is treated in a circulating gas stream along the inner wall of a vessel for a time sufficient to increase the bulk density of the granular detergent composition.

* * * * *